US005740557A

United States Patent [19]

Reid et al.

[11] Patent Number: 5,740,557

[45] Date of Patent: Apr. 21, 1998

[54] MAGNETIC IMAGE-DISPLAY SYSTEM FOR APPAREL

[76] Inventors: Gregory Reid, 3466 Armourdale Ave., Long Beach, Calif. 90808; John Burge, 19816 Blythe St., Canoga Park, Calif. 91306

[21] Appl. No.: 616,227

[22] Filed: Mar. 15, 1996

[51] Int. Cl.[6] ..... A42B 1/24

[52] U.S. Cl. ..... 2/209.13; 2/195.1; 2/244; 2/245; 36/136; 40/329; 40/586; 40/600; 40/621; 40/636

[58] Field of Search ..... 2/160, 209.13, 2/209.14, 244, 245, 246, 195.1; 40/329, 586, 600, 621, 636; 36/136, 137

[56] References Cited

U.S. PATENT DOCUMENTS

| | | | |
|---|---|---|---|
| 459,942 | 9/1891 | Brown | 2/209.13 |
| 3,782,012 | 1/1974 | Price | 40/1.5 |
| 4,509,277 | 4/1985 | Bolton | 40/1.5 |
| 4,611,355 | 9/1986 | Galanto et al. | 2/246 |
| 4,776,043 | 10/1988 | Coleman | 2/199 |
| 5,052,081 | 10/1991 | Fuehrer | 24/3 J |
| 5,067,265 | 11/1991 | Harms | 40/1.5 |
| 5,136,726 | 8/1992 | Kellin et al. | 2/244 |
| 5,359,733 | 11/1994 | Brannon et al. | 2/195.1 |
| 5,359,734 | 11/1994 | Rathburn | 2/195.1 |
| 5,369,899 | 12/1994 | Reeves | 40/1.5 |
| 5,571,020 | 11/1996 | Troudet | 2/160 |

*Primary Examiner*—Diana Biefeld

[57] ABSTRACT

This invention modifies nearly any form of apparel, including baseball-style hats, by incorporating a portion of magnetic material into the article of apparel which allows for releasable attachment of a plurality of magnetic-based display panels.

19 Claims, 5 Drawing Sheets

MAGNETIC IMAGE-DISPLAY SYSTEM FOR APPAREL

FIELD OF THE INVENTION

This invention relates to various types of apparel, including baseball-style hats, which may accommodate a variety of interchangeable display panels.

BACKGROUND-DESCRIPTION OF THE PRIOR ART

Hats, shirts, shoes and various other forms of apparel are commonly sold with various images displayed on them. Often, these images include licensed properties from professional sports organizations such as the logos of professional sports teams, as well as entertainment properties including television and movie figures and characters, cartoon characters and comic book characters. Other images often displayed on apparel include the names and images of people and places, slogans and phrases, or the names, trade names or logos of products, services and companies. When these images are displayed on an article of apparel, they constitute a form of expression for the wearer. The also may be form of advertisement or promotion for the manufacturer, licensor, licensee, or seller of the item of apparel.

As a matter of human nature, people have changing tastes, and constantly seek for variety. As a result, consumers tend to want to wear different articles of apparel, with different images, at different times. Manufacturers and sellers of indicia-bearing apparel try to take advantage of these changing tastes and preferences by offering a wide variety of styles with a wide variety of images in an effort to sell as many different articles of apparel as possible. However, considering current apparel design, for apparel images to be changed the wearer generally must purchase another item of apparel. The expense of purchasing new items of apparel limits the ability of the ordinary consumer to satisfy changing tastes and preferences, thereby also limiting the sale and manufacture of image-bearing apparel. Additionally, storage space may also be a limiting factor for consumers seeking to collect image-bearing apparel.

Attempts have been made to overcome some of the problems described above. Pins, designed for attachment to articles of apparel, are often sold with images, logos, and slogans, and may be releasably mounted on apparel. Although pins have been known for decades, and have found a niche market for consumers who like to attach pins to articles of apparel, they have not gained widespread acceptance as a method for releasable attachment of popular images to apparel, particularly licensed sports and entertainment images. Pins also do not provide a flush fit with the article, are difficult to mount and remove, and tend to sag and pull at the fabric to which they are mounted. They also tend to flop around with sudden movement of the wearer. Their utility is limited in that they may only be mounted on fabric which may be penetrated by a pin.

With respect to headwear, various hats have been developed with hook and loop fastening systems which allow for releasable attachment of cloth patches to hats. These hats generally attempt to simulate the look of an ordinary hat. Much like pins, these hook and loop fastening systems have not gained widespread acceptance as a method for releasable attachment of popular images. The present invention is also designed to overcome many of the shortcomings of the hook and loop fastening systems. These shortcomings include:

(1) hook and loop fastening systems do not facilitate attachment of high definition images (2) hook and loop fastening systems do not facilitate attachment of three dimensional molded caricatures as hook and loop fastening systems would flex under the weight of the caricature. As the caricature extended away from the hat surface, the leverage exerted by the weight of the caricature would cause it to sag by stretching upper portions of the hook and loop attachments;

(3) once mounted, it is difficult to adjust a hook and loop patch; for accurate attachment the user must remove the hat from his/her head;

(4) for comfortable removal of hook and loop patches, the user must remove the hat from his/her head;

(5) hook and loop patch removal is noisy;

(6) hook and loop fastening material tends to attract lint and tends to hook onto or snag other materials during storage and handling;

(7) With increased use, hook and loop fasteners tend to lose pull, resulting in loose edges and unappealing appearance.

With respect to other inventions which may be releasably attached to apparel, the prior art reveals name plate assemblies which are designed to be worn on the shirts of convention participants for name identification purposes. These name plate assemblies generally include a ferrous metal name plate which is place on the outside of a garment and a magnetic receiving member which is placed on the inside leaving a layer of fabric in between. These assemblies are basically designed to replace paper name tags with adhesive backings which are commonly used at such events to identify the names of participants.

None of the above inventions and patents, taken either singly or in combination, is seen to describe the instant invention as claimed.

SUMMARY OF THE INVENTION

The present invention provides an interchangeable magnetic display system which allows for a plurality of different magnetic display panels, bearing visual indicia, to be releasably attached to articles of apparel which incorporate a portion of magnetic material designed to accept the magnetic display panels.

OBJECTS AND ADVANTAGES

The claimed Magnetic Image-Display System for Apparel provides for a unique method of interchangeable image display on apparel and allows for new kinds of materials to be releasably attached to apparel. It provides for non-textile high definition images to be easily and releasably mounted on apparel, including silkscreened images, photographic images, holographic images, foil images, injection molded images, painted images, and three dimensional images or characters, as well as any other image created by a technique known to those skilled in the art. The Magnetic Image-Display System can support nearly unlimited range of image preferences, and allows the user to easily mount designs of their own creation including painting their own designs on blank magnetic panels or mounting photographic images on magnetic display panels. The magnetic system provides a unique mechanism for public display of collected items.

In the preferred embodiment, the Magnetic Image-Display System employs a baseball style hat, fitted with a metal plate on the front of the crown, and a plurality of indicia-bearing magnetic display panels which may be releasably attached to the plate. It allows for immediate entry into the collectibles market. Magnetic display panels may be collected and traded much like baseball cards or milk caps. The same indicia commonly found on baseball cards and milk caps may be placed on a flexible magnetic panel and displayed on a garment. Aside from other shortcomings, display panels contemplated by hook and loop fastening systems, textile patches with indicia created by sewing or stitching, are incapable of the image resolution necessary to display the photographic images and detailed data generally found on popular collectible items such as sports cards (such as baseball cards), other types of cards, and milk caps.

This Magnetic Image-Display System not only allows for interchangeability of displayed images, it also allows the wearer to choose the type of article of apparel used for display. Since this invention encompasses multiple forms of apparel, the wearer may display collected magnetic display panels on any form of apparel which is capable of being fitted with a plate capable of attracting the magnetic display panels. Different articles of apparel may be sold with plates of the same (standardized) dimensions. Thus, for example, the wearer may wear his/her favorite display panel on a hat one day, and a shirt or shoe the next day. In addition to apparel display, the wearer may also display magnetic panels, which are not currently being used on apparel, on any surface capable of attracting a magnet, including items such as most common household appliances, automobiles, or even walls painted with a magnetic paint.

Further objects and advantages will become apparent from consideration of the ensuing description and drawings.

DRAWINGS FIGURES

Figure 3A:
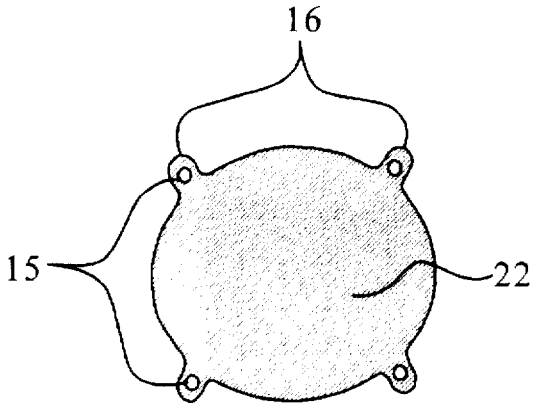

FIG. 3*a* is a front elevation view of the metal plate.

Figure 3B:
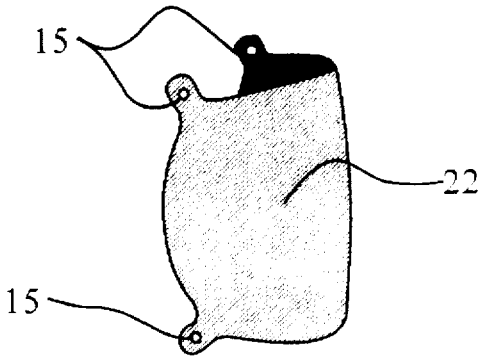

FIG. 3*b* is a side perspective view of the metal plate.

Figure 4A:
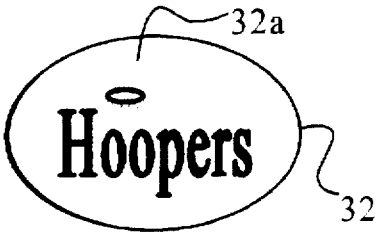

FIG. 4*a* is a from elevation view of an oval shaped magnetic display panel showing visual indicia in the form of a sports team name/logo.

Figure 4B:
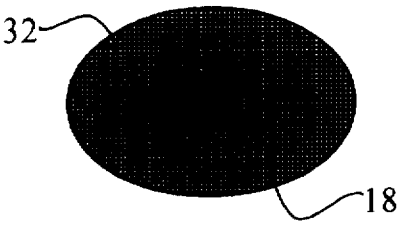

FIG. 4*b* is a rear elevation view of an oval shaped magnetic display panel showing the bare magnetic surface.

Figure 4C:
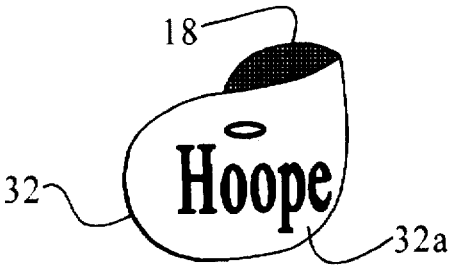

FIG. 4*c* is a side perspective view of an oval shaped magnetic display panel bearing a sports team name/logo.

Figure 5:
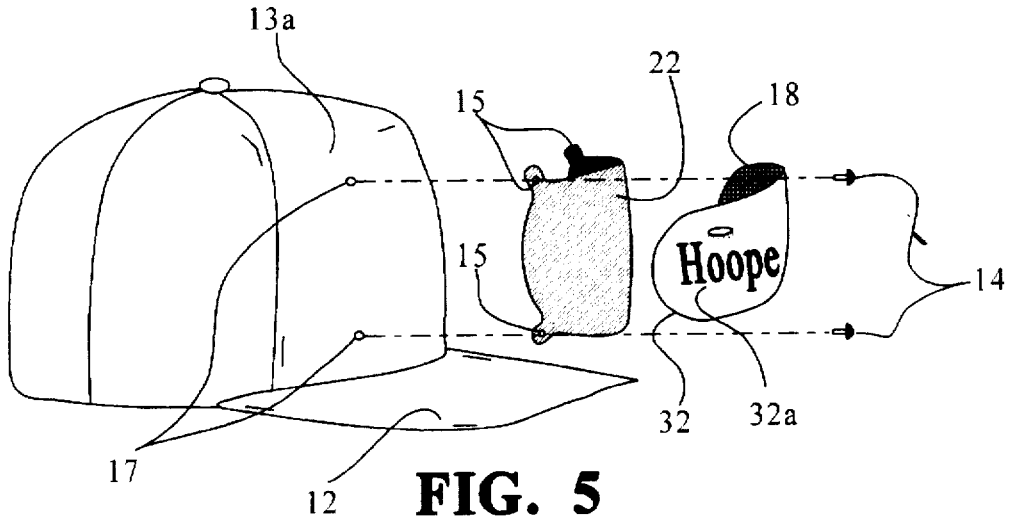

FIG. 5 is an exploded side perspective view of a baseball style hat with an oval shaped metal plate (shown with rivet extensions) affixed to the front of the hat with an oval shaped magnetic display panel bearing visual indicia.

Figure 6:
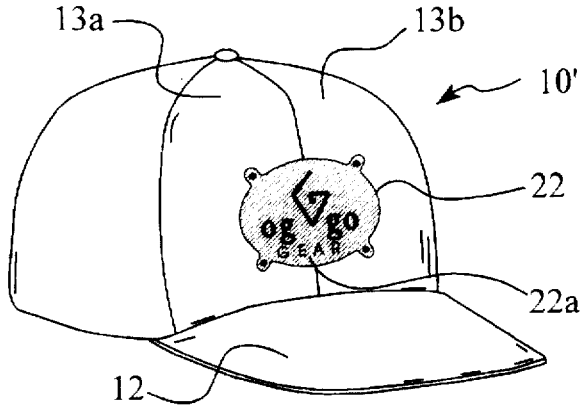

FIG. 6 is a front perspective view of baseball style hat with an oval shaped metal plate (shown with rivet extensions) affixed to the front wherein the metal plate bears visual indicia.

Figure 7:
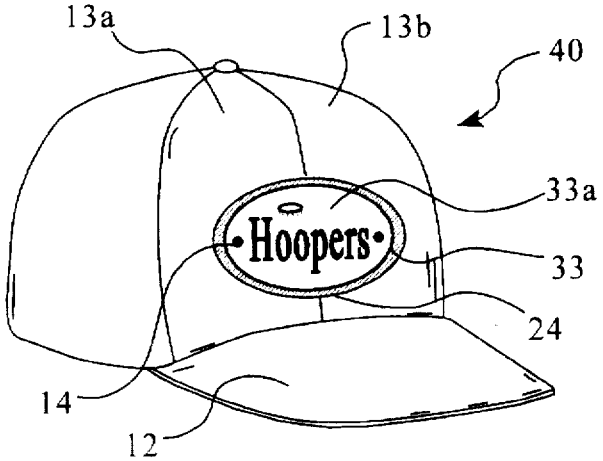

FIG. 7 is a front perspective view of a baseball style hat with an oval shaped metal plate affixed to the front of the hat with an oval shaped magnetic display panel bearing visual indicia wherein the attaching devices used to affix the plate to the hat protrude through corresponding holes in the magnetic display panel.

Figure 8:
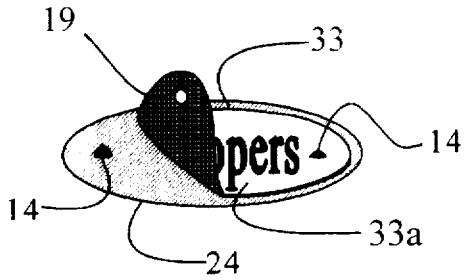

FIG. 8 is a front elevation view of an oval shaped metal plate with an oval shaped display panel mounted on it, wherein a portion of the magnetic display panel is peeled back showing the heads of attaching devices designed to protrude through corresponding holes in a mounted magnetic display panel.

Figure 9:
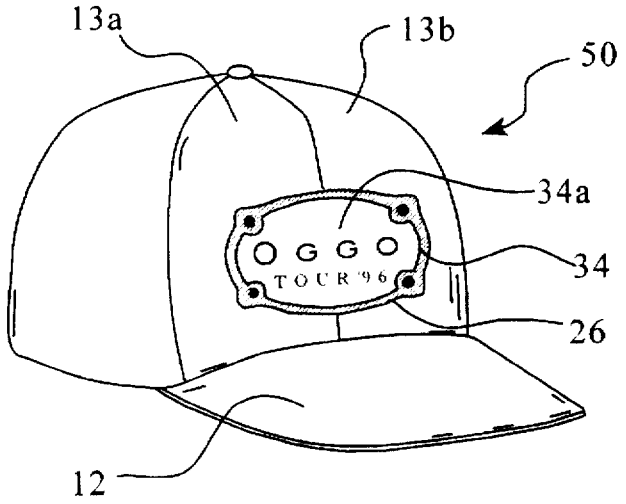

FIG. 9 is a front perspective view of a baseball style hat with an oval shaped metal plate (shown with half-extensions for rivets) affixed to the front of the hat with a modified oval shaped display panel bearing visual indicia.

Figure 10A:
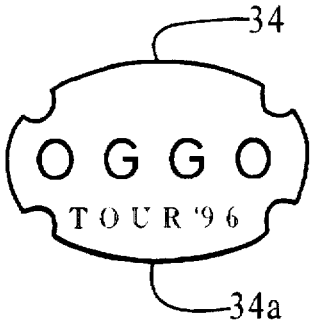

FIG. 10*a* is a front elevation view of a modified oval shaped display panel bearing the name of a rock band.

Figure 10B:
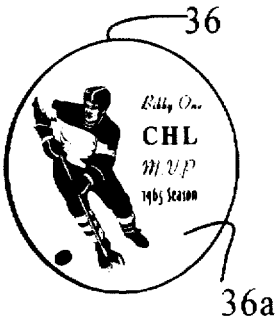

FIG. 10*b* is a front elevation view of a circular shaped magnetic display panel bearing a baseball card-style hockey player with statistics.

Figure 10C:
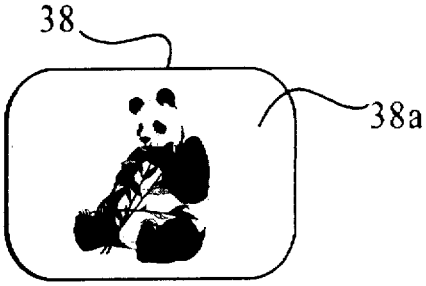

FIG. 10*c* is a front elevation view of a rectangular shaped magnetic display panel bearing a photograph of an animal.

Figure 11:
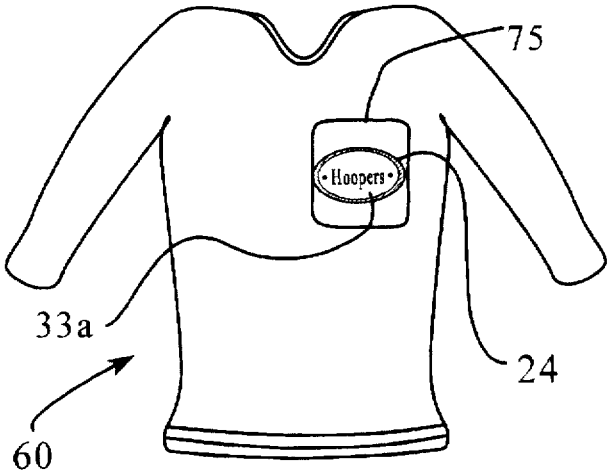

FIG. 11 is a front elevation view of a shirt with an oval shaped metal plate affixed to the front of the shirt with a magnetic display panel bearing the logo of a sports team.

Figure 12:
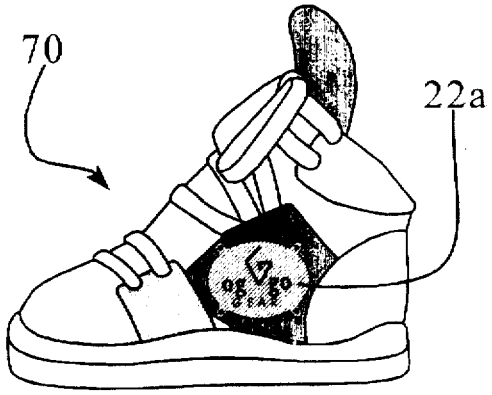

FIG. 12 is a side view of a shoe with an oval shaped metal plate (shown with rivet extensions) affixed to the side of the shoe bearing visual indicia in the form of a company/product name.

Figure 13:
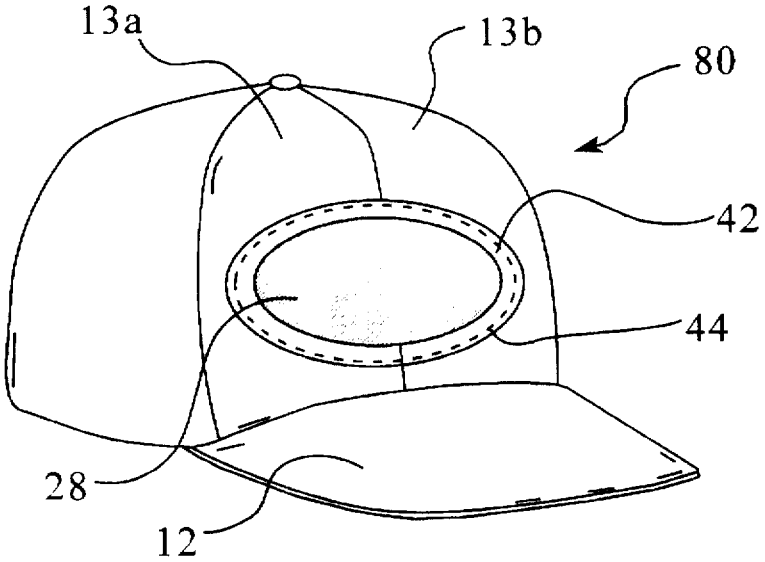

FIG. 13 is a front perspective view of a baseball style hat with a pocket sewn on the front which contains an oval shaped metal plate.

Reference Numerals In Drawings

10 hat with oval shaped plate with 4 rivet extensions
10' hat with oval shaped plate bearing visual indicia with 4 rivet extensions
11 crown of hat
12 bill of hat
13*a* front left panel of crown of hat
13*b* front right panel of crown of hat
14 rivets
15 rivet holes in plate
16 plate extensions for rivet holes
17 rivet holes in front panels of hat
18 magnetic material
19 holes in magnetic panel
22 oval shaped metal plate with 4 rivet extensions
22*a* visual indicia on an oval shaped metal plate
24 oval shaped metal plate with two rivet holes without rivet extensions
26 oval shaped metal plate with 4 half-extensions for rivets
28 oval shaped metal plate with no rivet holes
32 oval shaped magnetic display panel
32*a* visual indicia on an oval shaped magnetic display panel
33 oval shaped magnetic display panel with holes to accommodate rivet heads
33*a* visual indicia on oval shaped magnetic display panel with rivet head holes
34 modified oval shaped magnetic display panel
34*a* visual indicia on modified oval shaped magnetic display panel
36 circular shaped magnetic display panel
36*a* visual indicia on a circular shaped magnetic display panel
38 rectangular shaped magnetic display panel
38*a* visual indicia on a rectangular shaped magnetic display panel
40 hat with oval shaped plate with two rivet holes and no rivet extensions
42 pocket sewn onto front of hat
44 stitching attaching pocket to front of hat
50 hat with oval shaped metal plate with 4 half-extensions for rivets
60 shirt with oval shaped metal plate

70 athletic shoe with oval shaped metal plate
75 shirt pocket
80 hat with pocket sewn into the front

DESCRIPTION OF THE PREFERRED EMBODIMENTS

Figure 1:
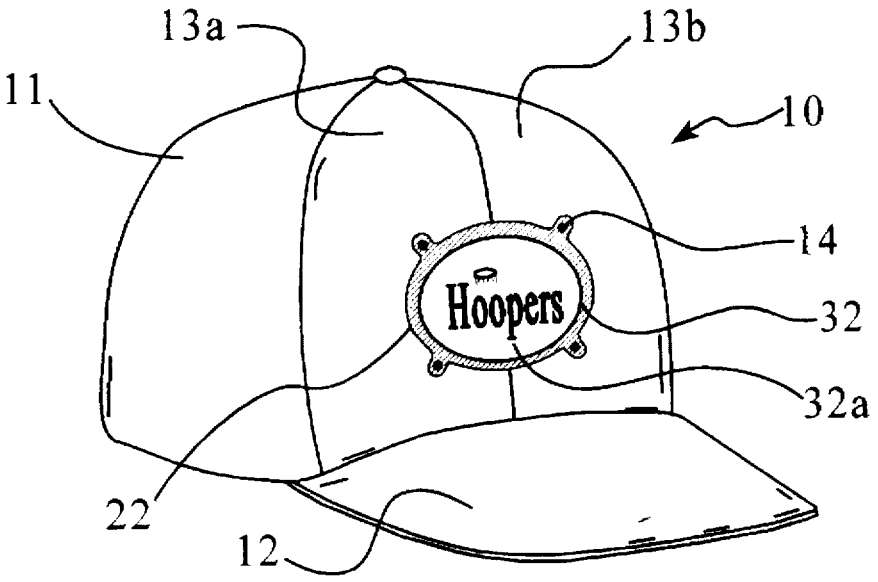
FIG. 1 is a front perspective view of a baseball style hat with an oval shaped metal plate (shown with rivet extensions) affixed to the front of the hat with an oval shaped magnetic display panel bearing visual indicia.

FIG. 1 shows a hat 10 with attached metal plate 22 affixed to the essentially vertical external front wall of the hat (See FIG. 5 for an exploded view). The plate 22 is shown attached to the front left hat panel 13*a* and front right hat panel 13*b* by way of rivets 14. Releasably attached to the metal plate is a magnetic display panel 32, here shown bearing visual indicia 32*a* in the form of a professional sports team logo.

As shown in FIG. 1, the hat 10 is preferably a standard, adjustable, billed baseball-style cap made of fabric, leather, plastic or other appropriate material. The hat 10 includes a bill 12, which serves as a shade or visor for the wearer, and a crown 11. The crown 11 is substantially dome shaped, generally comprised of 5 or 6 panels. The front wall of the hat, front panels 13*a* and 13*b*, may be slightly deformed from the dome shape as a result of a portion of shaping material being attached to the inside of the front panels, thereby rendering the front wall of the hat essentially vertical. The crown has a horizontal curvature which may be slightly adjusted to fit the wearer's head size.

Figure 2:
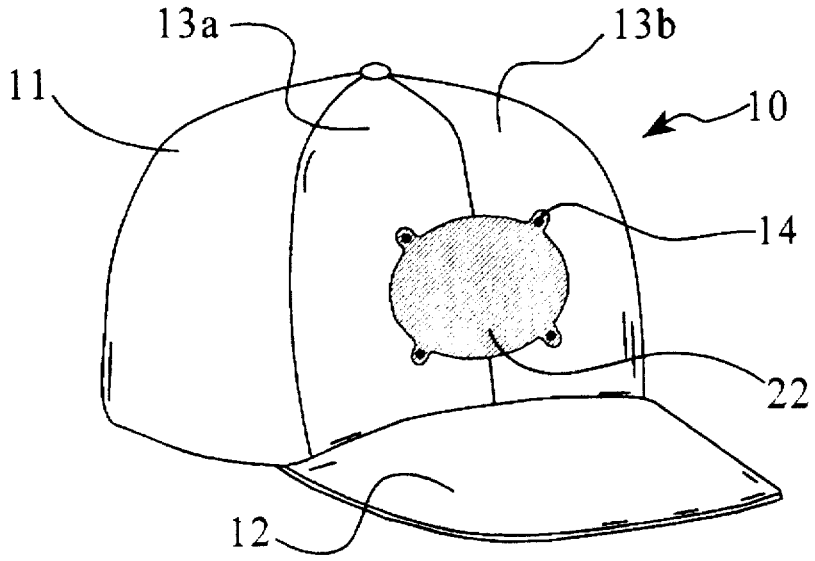
FIG. 2 is a from perspective view of baseball style hat with an oval shaped metal plate (shown with rivet extensions) affixed to the front of the hat.

FIG. 2 shows hat 10 and attached metal plate 22 without a mounted magnetic display panel. The plate is preferably made of a ferromagnetic metal, but may be made from any material known to those skilled in the art which is capable of attracting a magnet through magnetic attraction. Such materials may include many forms of steel including cold rolled steel, some types of stainless steel, as well as other magnetic materials and materials known to those skilled in the art.

FIG. 3*a* is a front elevation view of the metal plate 22 described above. Plate 22 is essentially oval shaped with rivet holes 15 and plate extensions 16 to accommodate the rivet holes. The plate may be laser cut from a sheet of metal, die-stamped, forged, mechanically cut, hand cut, or formed from any metal forming process known to those skilled in the art. The plate may have a horizontal curvature or radius approximately that of the hat crown 11 so as to provide a neat fit on the essentially vertical front wall of the hat crown 11. FIG. 3*b* shows a side perspective view of a metal plate 22 shaped to the approximate horizontal curvature of the crown of the hat so as to provide a flush fit with the crown fabric. While most baseball style hats do not have an exactly vertical front wall, the vertical curvature of the crown of most baseball style hats is not as extreme as the horizontal curvature thereby making it unnecessary to apply a vertical curvature or radius to the plate 22 in most circumstances. The plate 22 is preferably made of, or coated with, a corrosion resistant material. Many metals which have strong magnetic properties are not corrosion resistant due to a high iron content. Accordingly, most types of metal with the necessary magnetic properties should be electroplated with a non-corrosive metal, or coated with a clear or colored coating, such as paint, to prevent oxidation and corrosion.

FIG. 5 shows an exploded side perspective view of the hat shown in FIG. 1. It shows attaching devices in the form of rivets 14 being used to affix the metal plate 22 through holes 15 in the metal plate and through holes 17 in the front panels of the hat 13*a* and 13*b* (13*b* obscured by perspective view). Other attaching devices may be used such as screws, nuts, bolts, pins eyelets, clamps, adhesives, thread and any other attaching device known to those skilled in the art.

A plurality of separate magnetic display panels bearing visual indicia may be utilized with a single hat. FIG. 4*a* shows the front side of a magnetic display panel 32 bearing visual indicia 32*a* in the form of a sports team logo. The visual indicia 32*a* may be created using almost any image creation technique including silkscreening, molding, photography, holography, painting, injection molding, and any other artistic image creation technique known to those skilled in the art. FIG. 10*a* shows the front elevation view of a modified-oval shaped magnetic display panel 34 bearing the image of a rock band 34*a*, where the oval shape has been modified so as to avoid contact with the heads of the rivets 14 used to affix the plate with half-extensions 26 to an article of apparel. FIG. 10*b* shows the front surface of a circular shaped magnetic display panel 36 bearing the image of a hockey player and information about that player and his/her team 36*a*. This design would be utilized in cases where the corresponding metal plate on the article of apparel was manufactured in a circular shape. FIG. 10*c* shows the front surface of a rectangular shaped magnetic display panel 38 bearing the image of a photograph of a panda 38*a*. This design would be utilized in cases where the corresponding metal plate on the article of apparel was manufactured in a rectangular shape.

FIG. 4*b* shows the magnetic surface 18 of the backside of a magnetic display panel 32 which provides the magnetic attraction necessary for the magnetic display panel to attach to the metal plate. The magnetic material which comprises the back of the magnetic display panel is preferably cut or stamped from a flexible magnetic sheeting material similar to that which comprises kitchen magnets and other magnetic signs, or from any other magnetic material known to those skilled in the art. As shown in FIG. 4*c*, the flexibility of this material allows the magnetic display panel 32 to conform to the horizontal curvature of the metal plate which may be necessary when the article of apparel has a curved surface such as a hat or shoe. The panel may also be made from an inflexible magnetic material, and shaped or molded to the curvature of the metal plate. The display panels may also be manufactured with indicia on both sides of the panels, allowing them to be reversible. The wearer may wear the display panel with one surface exposed for a period of time, and then flip the display panel over to expose a different display.

As used throughout this application, the term "magnetic material" is defined to include materials capable of attracting a magnet (including ferromagnetic metals) as well as materials which are actually magnetized and/or commonly known as "magnets." While the preferred embodiment shown employs a display panel made of a flexible magnetic material and a plate made of a ferromagnetic metal permanently affixed to an article of apparel, other combinations are possible within the scope of this invention. For example, in another embodiment the materials may be reversed as between the plate and display panel. The plate may be made of a rigid nonmetal magnetic material with the display panel made of either a flexible non-metal magnetic material or a ferromagnetic metal. As long as either the display panel, or the plate are magnetized, and the other either magnetized or capable of attracting a magnetized object, the desired magnetic attraction will result. The magnetic attraction between the display panel and plate must be sufficient to hold the weight of the display panel when mounted.

FIG. 6 shows a metal plate 22 with plate visual indicia 22*a* in the form of a trade name. Plate visual indicia 22*a* may be applied to the plate by several methods including engraving, stamping, painting, electroplating, laser cutting or by any other method known to those skilled in the art. While the metal plate 22 may be oval as shown in FIG.'s 1,2,5, and 6, it may be any shape.

There are various possibilities for attachment of the plate to the crown of the hat. As shown in FIG.'s 1,2, and 5, the plate may be attached by rivets. The plate may also be attached by other hardware including screws, bolts, nuts, pins, eyelets, clamps, stitching or by glue, and/or by any other methods used by those skilled in the art to connect a plate to fabric. As shown in FIG. 13, a pocket 42 may be sewn onto an article of apparel into which a metal plate 28 may be inserted. Once inserted, only the outside edges of the plate will be covered by the pocket material, with the bulk of the plate being visible. The pocket is preferably made from a stretchable material, or a fabric which incorporates a stretchable material such as Spandex™, Lycra™, rubber and any other stretchable material known to those skilled in the art. The plate may be mounted on the hat by stretching the pocket open and inserting the plate inside. In this embodiment the plate may be removed by the wearer, allowing the wearer to utilize different plate styles on one hat to further accomodate changing wearer tastes.

As shown in FIG. 3*a*, if rivets are used to affix the metal plate 22 to the crown of the hat 11, the metal plates may be modified by the addition of plate extensions 16 to accommodate rivet attachment. As shown in FIG. 5, these extensions prevent the heads of rivets 14 from interfering with flush contact between the magnetic surface 18 of the oval shaped magnetic display panel 32 and the front surface of the metal plate 22. As shown in FIG.'s 7,8 and 11, the metal plate 22 may be affixed to the crown of the hat 11 without plate extensions by placing holes in the magnetic display panel 33 so that the rivet heads 14 protrude through the magnetic display panel 33. Alternatively, the panel could be formed with indentations in the back surface which are not visible from the front but are sufficient to accomodate the depth of the rivet heads. For example, the tradename "Oggo" may be slightly raised off the plate such that it interlocks with a corresponding "Oggo" cut out of the backsurface of the magnetic display panel. This may provide a means for assuring the purchaser that they have purchased a magnetic display panel authorized by the manufacturer ("Oggo") of the article of apparel. It will also assist the wearer in insuring that the magnetic display panel is properly oriented.

FIG. 11 shows a sweatshirt-style shirt 60 with an affixed metal plate 24 affixed to a pocket 75 sewn on the shirt. Releasably attached to the metal plate 24 is a magnetic display panel, here shown bearing visual indicia 32*a* in the form of a professional sports team logo. The shirt may be any form of shirt known to those skilled in the art including but not limited to button down shirts with collars, sweatshirts, and T-shirts, and contains at least a back portion, chest portion, and arm portions.

FIG. 12 shows an athletic shoe 70 with an affixed metal plate bearing visual indicia 22*a*. Like with the above described hats and shirts, the metal plate is sized to accept a plurality of releasable magnetic display panels.

In operation, the wearer of the hat or other apparel can releasably attach a magnetic display panel simply by placing the magnetic side of a magnetic display near the surface of the metal plate. The magnetic display will then click onto the metal plate as a result of magnetic attraction once the magnetic surface is close enough to the metal surface for magnetic attraction to pull the parts together. The display panel may then be easily adjusted to the center of the plate. This procedure can easily be performed while the wearer is wearing the hat or item of apparel. The wearer can feel with her/his fingers whether the panel is properly centered. In the embodiment where plate protrusions are utilized, the wearer will be assured that the display panel is centered when the plate protrusions interlock with indentations in the back surface of the display panel, and the display panel thereby sets flush on the plate.

If a flexible magnetic display panel is utilized, the strength of the magnetic attraction may vary with the thickness of the panel. In general, the thicker the display panel, the greater the attraction. For hats and shoes, as the thickness of the display panel increases, the flexibility generally decreases and hence decreases the ability of the magnetic display panel to conform to the shape of the metal plate. Flexibility may also be affected by the type of, and flexibility of, the visual indicia on the magnetic display panel. Flexibility will also be effected in the embodiment where indicia is placed on both side of the display panel, in which cases the display panel is reversible and may be worn with either surface mounted on the hat.

A wearer may select a display panel from a collected group of display panels, and place that display panel on the hat. The wearer may later select a different display panel from the collection, and mount it in place of the previously selected panel which would be returned to the collection. When the wearer is not wearing a magnetic display panel, it may be easily stored on any surface capable of attracting a magnet. Much like a kitchen magnet, it may be stored, or displayed, on most kitchen appliances (including refrigerators), cars, and any other item made of a magnetic substance. The wearer may wear a particular display panel for a period of time, and then replace it with a different display panel, thereby altering the look of the article of apparel and changing the message or look which the wearer seeks to convey.

Ramifications, and Scope

Accordingly, the reader will see that the above described Magnetic Image-Display System can be used to provide a hat, or nearly any item of apparel, which may accept an infinite variety of display panels containing images that can be created via almost any artistic medium. The Magnetic Image-Display System provides a neat, clean and quiet system for releasable attachment of display panels.

While this invention has been described in connection with the preferred embodiment thereof, it is obvious that modifications and changes therein may be made by those skilled in the art without departing from the spirit and scope of the invention. Accordingly, the scope of this invention is to be limited only by the appended claims.

We claim:

1. An article of apparel, wherein a portion of said article of apparel is comprised of a metal plate capable of attracting a magnet, said metal plate having inner and outer surfaces, said inner surface being mounted facing said article of apparel by a non-magnetic means, and said outer surface facing away from said article of apparel such that at least a portion of said outer surface of said metal plate comprises an exterior surface of said article of apparel whereby said portion of said outer surface of said metal plate may be visible to public view while said article of apparel is being worn.

2. The article of apparel of claim 1 wherein said metal plate is oval shaped.

3. The article of apparel of claim 1 wherein said metal plate is affixed to said article of apparel by an attaching device selected from the group consisting of one or more rivets, screws, nuts, bolts, pins, eyelets, clamps, and an adhesive compound, wherein said metal plate is affixed such that the entirety of said inner surface of said metal plate is substantially in contact with said article of apparel, and wherein said metal plate has a substantially smooth surface whereby a section of magnetic sheeting magnetically attached to said metal plate would not be inhibited from laying flush against said metal plate.

4. The article of apparel of claim 3 wherein said metal plate is comprised of a type of stainless steel which is capable of attracting a magnet.

5. The article of apparel of claim 4 wherein said metal plate is oval shaped.

6. The article of apparel of claim 1 wherein said article of apparel includes a pocket comprised of a strip of flexible material, firmly attached to said article of apparel and positioned around the edges of said metal plate such that said strip of flexible material holds said metal plate firmly in place on said article of apparel.

7. A baseball-style hat, comprised of a crown and bill, said bill extending outwardly from and located below a frontal portion of said crown, wherein a portion of said baseball-style hat has a plate affixed thereto, wherein said late is comprised of a magnetic material capable of attracting a magnet, wherein said plate has inner and outer surfaces, said inner surface being mounted facing said baseball-style hat by a non-magnetic means, and said outer surface facing away from said baseball-style hat such that at least a portion of said outer surface of said plate comprises an exterior surface of said baseball-style hat.

8. The baseball-style hat of claim 7 wherein said crown is comprised of a plurality of panels connected together to form a generally dome-shaped configuration, having an apex at a top of said dome-shaped configuration and a peripheral rim at a bottom of said dome-shaped configuration, said bill connected to and extending outward from said peripheral rim and said frontal portion comprising a portion of said crown between said bill and said apex.

9. The baseball-style hat of claim 8 wherein said plate is comprised of a metal capable of attracting a magnet, and wherein said frontal portion is curved and said plate is curved such that said curvature of said plate substantially conforms to said curvature of said frontal portion.

10. The baseball-style hat of claim 9 wherein said plate is comprised of a type of stainless steel which is capable of attracting a magnet.

11. The baseball-style hat of claim 10 wherein said plate is substantially oval shaped.

12. The baseball-style hat of claim 9 wherein said baseball-style hat contains a pocket comprised of a flexible strip of material, firmly attached to said baseball-style hat and positioned around the edges of said plate such that said flexible strip of material holds said plate firmly in place on said baseball-style hat of apparel.

13. An interchangeable magnetic display system comprising:

(a) an article of apparel; and (b) a metal plate capable of attracting a magnet, having inner and outer surfaces, said inner surface being mounted facing said article of apparel by a non-magnetic means, and said outer surface facing away from said article of apparel such that at least a portion of said outer surface of said metal plate comprises an exterior surface of said article of apparel whereby said portion of said outer surface of said metal plate may be visible to public view while said article of apparel is being worn; and (c) at least one magnetic display panel, having inner and outer surfaces, bearing visual indicia on one or more of said surfaces of said magnetic display panel, and comprised of a magnetic material enabling said magnetic display panel to releasably attach to said metal plate by means of magnetic attraction between said magnetic display panel and said metal plate.

14. The interchangeable magnetic display system of claim 13 wherein said magnetic display panel is comprised of flexible magnetic sheeting.

15. The interchangeable magnetic display system of claim 14 wherein said magnetic display panel is substantially the same shape as said exposed surface of said metal plate.

16. The interchangeable magnetic display system of claim 15 wherein said metal plate has a substantially oval shape.

17. The interchangeable magnetic display system of claim 13 wherein said metal plate is comprised of a type of stainless steel which is capable of attracting a magnet and is permanently affixed to an exterior of said article of apparel.

18.The interchangeable magnetic display system of claim 17 wherein said article of apparel is a baseball-style hat comprising a crown and bill, said bill extending outwardly from and located below a frontal portion of said crown, with said crown being comprised of a plurality of panels connected together to form a generally dome-shaped configuration having an apex at a top of said dome-shaped configuration and a peripheral rim a bottom of said dome-shaped configuration, said bill connected to and extending outward from said peripheral rim and said frontal portion comprising a portion of said crown between said bill and said apex, wherein said frontal portion is curved and said metal plate is curved such that said curvature of said metal plate substantially conforms to said curvature of said frontal portion.

19. The interchangeable magnetic display system of claim 18 wherein said magnetic display panel is comprised of flexible magnetic sheeting and capable of substantially conforming to the curvature of said metal plate.

* * * * *